US005829697A

United States Patent [19]

Kroger

[11] Patent Number: 5,829,697

[45] Date of Patent: Nov. 3, 1998

[54] SUPPORT FOR CYLINDERS IN A PAPER SHREDDER

[75] Inventor: Bruce R. Kroger, West Chicago, Ill.

[73] Assignee: Fellowes Manufacturing Company, Itasca, Ill.

[21] Appl. No.: 889,243

[22] Filed: Jul. 8, 1997

Related U.S. Application Data

[63] Continuation of Ser. No. 519,409, Aug. 24, 1995, abandoned.

[51] Int. Cl.[6] ..... B02C 4/08

[52] U.S. Cl. ..... 241/236; 241/285.1

[58] Field of Search ..... 241/285.1, 166, 241/236, 167

[56] References Cited

U.S. PATENT DOCUMENTS

| | | |
|---|---|---|
| 1,019,828 | 3/1912 | O'Bryan . |
| 1,090,914 | 3/1914 | Guettler . |
| 1,178,386 | 4/1916 | Edwards . |
| 1,673,336 | 6/1928 | Lehmicke . |
| 1,699,157 | 1/1929 | Pendleton . |
| 1,731,967 | 10/1929 | Antonsen . |
| 2,182,219 | 12/1939 | Ashley . |
| 2,202,843 | 6/1940 | Edwards . |
| 2,216,612 | 10/1940 | Dimm et al. . |
| 2,224,948 | 12/1940 | Bloomquist . |
| 2,236,969 | 4/1941 | Flateboe . |
| 2,259,015 | 10/1941 | Anderson et al. . |
| 2,381,775 | 8/1945 | Roddy . |
| 2,554,114 | 5/1951 | Menkin et al. . |
| 2,657,720 | 11/1953 | Wolfe . |
| 2,770,302 | 11/1956 | Lee . |
| 2,873,923 | 2/1959 | Bergman . |
| 2,894,697 | 7/1959 | Panning et al. . |
| 3,033,064 | 5/1962 | Lee . |
| 3,126,931 | 3/1964 | Blanshine et al. . |
| 3,286,574 | 11/1966 | Durand . |
| 3,369,763 | 2/1968 | Perry . |
| 3,396,914 | 8/1968 | Liebman . |
| 3,510,077 | 5/1970 | Priscu . |
| 3,524,597 | 8/1970 | Burden, Jr. et al. . |
| 3,529,782 | 9/1970 | Liebman . |
| 3,620,461 | 11/1971 | Pelleschi et al. . |
| 3,620,462 | 11/1971 | Dooley, Jr. . |
| 3,630,460 | 12/1971 | Goldhammer . |
| 3,664,592 | 5/1972 | Schweigert et al. . |
| 3,682,402 | 8/1972 | Goldhammer . |
| 3,711,034 | 1/1973 | Ehinger . |
| 3,724,766 | 4/1973 | Bosland . |
| 3,790,093 | 2/1974 | McIntyre . |
| 3,797,765 | 3/1974 | Samuels . |
| 3,860,180 | 1/1975 | Goldhammer . |
| 3,880,361 | 4/1975 | Schwarz . |
| 3,894,697 | 7/1975 | Lawson et al. . |
| 3,921,920 | 11/1975 | Brocard . |
| 3,931,935 | 1/1976 | Holman . |
| 3,960,334 | 6/1976 | Wudyka . |

(List continued on next page.)

FOREIGN PATENT DOCUMENTS

| | | |
|---|---|---|
| 10681 | 10/1979 | European Pat. Off. . |
| 0069721 | 9/1982 | European Pat. Off. . |
| 3001507 | 7/1981 | Germany . |
| 3312173A1 | 11/1984 | Germany . |
| 705066 | 3/1954 | United Kingdom . |
| 1468662 | 5/1973 | United Kingdom . |
| 1502076 | 2/1978 | United Kingdom . |
| 1569375 | 6/1980 | United Kingdom . |
| 2059804A | 8/1980 | United Kingdom . |
| 2097717A | 3/1982 | United Kingdom . |

*Primary Examiner*—John M. Husar
*Attorney, Agent, or Firm*—Brinks Hofer Gilson & Lione

[57] ABSTRACT

A support placed in the cutting path of a multicylinder cutting assembly to prevent the shafts of the cutting cylinders from separating. In the preferred embodiment, the support comprises a base and two arm members extending upward from the base. The invention also includes a shredder comprising at least two cylinders; a plurality of cutting disks arranged on the cylinders; spacers alternatingly arranged on the cylinders between the cutting disks; and at least one support placed under the cylinders for preventing the cylinders from separating.

11 Claims, 3 Drawing Sheets

U.S. PATENT DOCUMENTS 4,009,838 3/1977 Tashman .
4,018,392 4/1977 Wagner .
4,034,918 7/1977 Culbertson et al. .
4,068,805 1/1978 Oswald .
4,106,708 8/1978 Kropa .
4,157,671 6/1979 Goldhammer .
4,172,400 10/1979 Brierley .
4,194,698 3/1980 Kosmowski .
4,200,239 4/1980 Simone et al. .
4,226,372 10/1980 Wigand .
4,257,565 3/1981 Hatanaka .
4,260,115 4/1981 Hatanaka .
4,330,092 5/1982 Roman .
4,334,650 6/1982 Hardwick et al. .
4,346,851 8/1982 Bernardi et al. .
4,349,159 9/1982 Hardwick et al. .
4,351,485 9/1982 Hardwick et al. .
4,355,766 10/1982 Wigand .
4,363,453 12/1982 Hill et al. .
4,385,732 5/1983 Williams .
4,394,983 7/1983 Ulsky .
4,399,946 8/1983 Stevenson .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,650,128 3/1987 Goldhammer .
4,651,610 3/1987 Schwelling .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,709,197 11/1987 Goldhammer et al. .
4,717,085 1/1988 Crane .
4,773,603 9/1988 Schwelling .
4,809,916 3/1989 Schwelling .
4,830,295 5/1989 Schwelling .
4,860,963 8/1989 Goldhammer et al. .
4,881,692 11/1989 Goldhammer et al. .
4,889,291 12/1989 Goldhammer et al. .
4,919,345 4/1990 Burlington et al. .
4,936,517 6/1990 Kammerer et al. .
4,997,134 3/1991 MacGregor .
5,044,270 9/1991 Schwelling .
5,071,080 12/1991 Herbst et al. .
5,141,168 8/1992 Pepper .
5,163,629 11/1992 Raterman et al. ..... 241/236
5,170,702 12/1992 Schwelling .
5,230,477 7/1993 Strohmeyer .
5,261,614 11/1993 Schwelling .
5,295,633 3/1994 Kimbro et al. .
5,400,978 3/1995 Strohmeyer ..... 241/166
5,409,171 4/1995 Stangenberg et al. .

SUPPORT FOR CYLINDERS IN A PAPER SHREDDER

This application is a continuation of application Ser. No. 08/519,409, filed Aug. 24, 1995 now abandoned.

BACKGROUND OF THE INVENTION

This invention pertains to the field of shredders. More specifically, the invention encompasses a shaft support for cylinders in a paper shredder.

Shafts for cutting cylinders are typically manufactured in one of two ways. They may be machined from a solid cylinder of steel. Alternately, they may be built up using separate cutters of steel, sintered metal, or other hard material on a shaft which uses the cross section of a polygon, a key, or some other feature to transmit power from the shaft to the cutters.

It is economically advantageous to make the cutting shaft as small in diameter as possible. However, the cutting cylinder experiences a considerable outward force as it attempts to cut increasing thicknesses of paper. Consequently, as the amount of paper to be shredded increases, a point is eventually reached where the paper bends the cutting cylinders. This results in paper passing through the shredder without being cut. One normal solution to this problem is to increase the diameter of the shaft or the beam strength of the material comprising the shaft. Unfortunately, this solution increases the cost of the paper shredder. An equally common solution is to decrease the power input. This solution is also undesirable because it decreases the capacity of the shredder. A large capacity shredder with a small diameter cutting cylinder would be a welcome improvement in the art.

SUMMARY

The present invention includes a support placed in the cutting path of a multicylinder cutting assembly to prevent the shafts of the cutting cylinders from separating. In the preferred embodiment, the support comprises a base and two arm members extending upward from the base such that each arm member is associated with a separate cutting cylinder.

The invention also encompasses a shredder comprising at least two cylinders; a plurality of cutting disks arranged on the cylinders; spacers alternatingly arranged on the cylinders between the cutting disks; and at least one support placed under the cylinders for preventing the cylinders from separating during operation of the shredder.

DETAILED DESCRIPTION OF THE DRAWINGS AND PREFERRED EMBODIMENTS OF THE INVENTION

Figure 1:
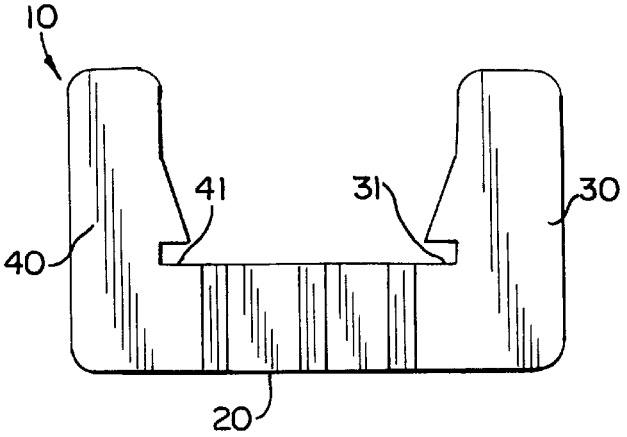
FIG. 1 is a front view of the preferred embodiment of the support of the present invention.
Figure 2:
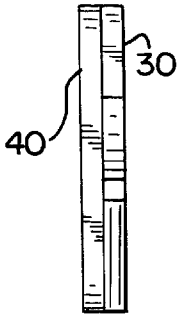
FIG. 2 is a side view of the support of FIG. 1.
Figure 3:
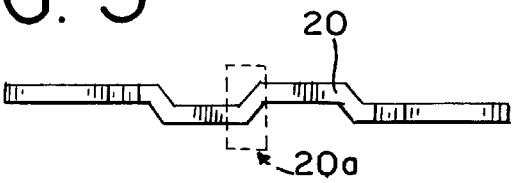
FIG. 3 is a bottom view of the support of FIG. 1.
Figure 4:
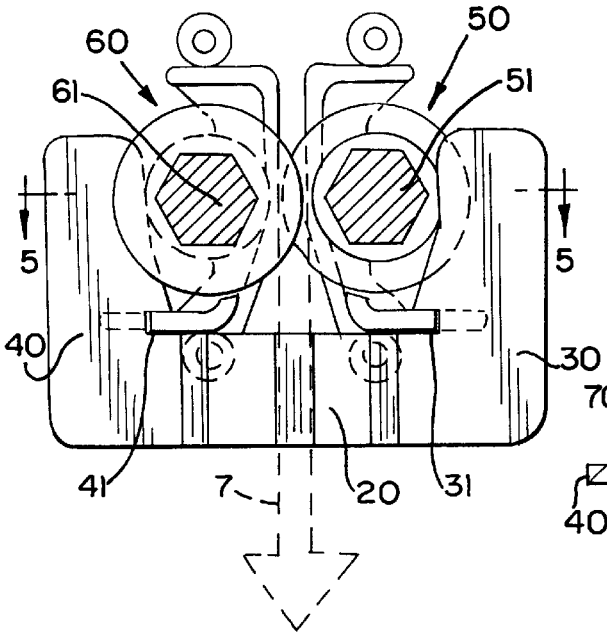
FIG. 4 is a side view of two cutting cylinders placed in a paper shredder that includes the support of FIG. 1.
Figure 5:
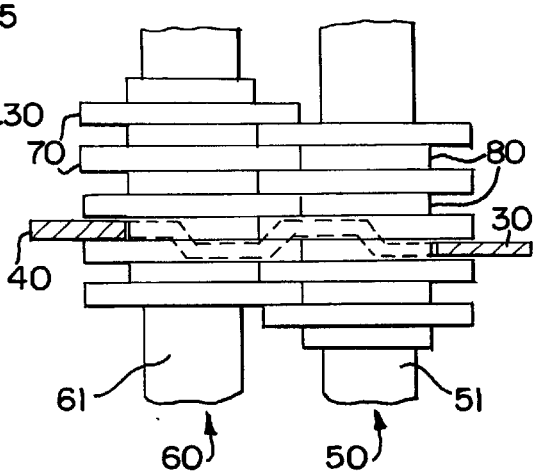
FIG. 5 is a cross-sectional view of the cutting cylinders of FIG. 4 taken along the line 5—5.
Figure 6:
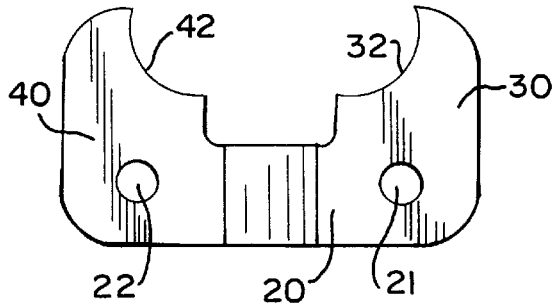
FIG. 6 is a front view of a second embodiment of the support of the present invention.

The present invention relates to a mid-shaft support for use in a paper shredder. The support is placed in the cutting path of a multicylinder cutting assembly to prevent the shafts of the cutting cylinders from separating. The preferred support 10 of the present invention is illustrated in FIGS. 1–5. As shown in FIG. 1, the support 10 comprises a base 20 and two arm members 30, 40 extending upward from the base 20. The width or thickness of the support 10 may vary. As depicted in FIGS. 4 and 5, each arm member 30, 40 of the support 10 should easily fit between two cutting disks on a cutting cylinder. In addition, the contour of the base 20 of the support 10 may vary. It is possible for the base 20 to be straight. However, a linear base 20 may be problematic because the support 10 is placed directly in the paper path and therefore becomes an obstacle for the shredded paper as it passes through the shredder. A nonlinear base 20 decreases the probability that the shredded paper will gather in the paper path. Therefore, the base 20 of the support 10 is preferably nonlinear as depicted in FIG. 3.

FIG. 4 illustrates the support 10 as it is properly positioned in a paper shredder. The shredder includes at least two cutting cylinders 50, 60. In the preferred embodiment, each cutting cylinder comprises a shaft 51, 61, a plurality of cutting disks 70 and a plurality of spacers 80. The spacers 80 may be formed integral with the cutting disks 70 or they may be separate components. The cutting disks 70 and spacers 80 may be placed on the shafts 51, 61 in any arrangement that will produce the desired cut. In the preferred embodiment depicted in FIG. 5, the cutting disks 70 and spacers 80 are alternatingly arranged on the shafts 51 and 61.

Figure 9:
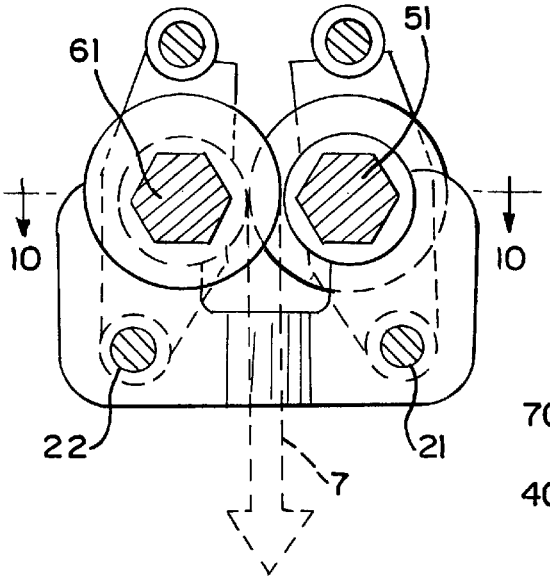
FIG. 9 is a side view of two cutting cylinders placed in a paper shredder that includes the support of FIG. 6.
Figure 14:
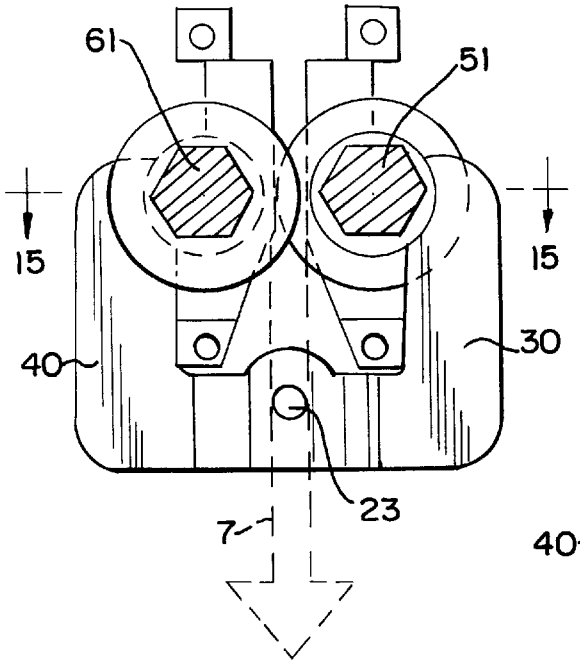
FIG. 14 is a side view of two cutting cylinders placed in a paper shredder that includes the support of FIG. 11.
Figure 15:
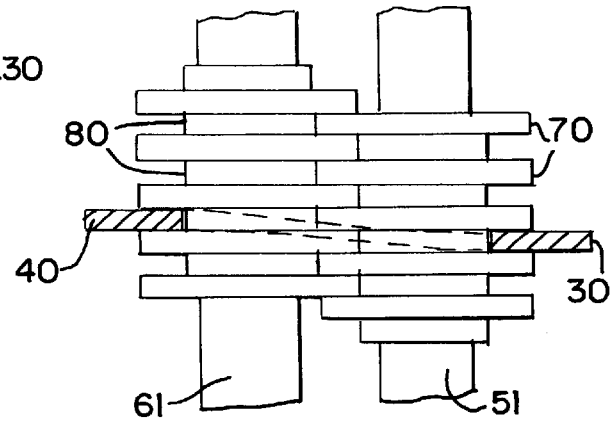
FIG. 15 is a cross-sectional view of the cutting cylinders of FIG. 14 taken along the line 15—15.

As best shown in FIGS. 4, 9, and 14, a vertical cutting path 7 is defined by a substantially vertical plane through the area where the cutting disks 70 of the cutting cylinders 50, 60 interleave. For the preferred embodiment, the portion of the base 20 that is within the cutting path 7 is represented by opposing dashed brackets and the reference numeral 20*a*, as shown in FIG. 3.

The method of securing the support 10 in position is not critical and may be accomplished by any feasible means. For example, the support 10 may be configured so that the arm members 30, 40 engage or surround part of the cutting cylinders 51, 61. Alternately, the support 10 may be secured in position by one or a plurality of shafts. In the preferred embodiment illustrated in FIG. 1, the support 10 includes a small recess 31, 41 where the arm members 30, 40 meet the base 20. The recess 31, 41 is adapted to receive a portion of another component that is associated with the cutting cylinders 51, 61, such as a stripper.

During operation of the shredder, the arm members 30, 40 of the support 10 prohibit the cutting cylinders 50, 60 from separating because they limit the amount of bending that may occur in the shafts 51, 61.

The support 10 may be manufactured from any material that is sufficiently strong to accomplish the function of limiting the bending of the cutting cylinders 50, 60. The preferred support 10 is made of cold, rolled steel.

Figure 7:
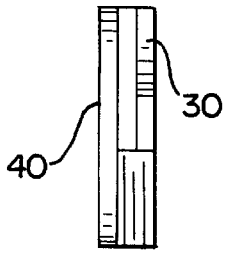
FIG. 7 is a side view of the support of FIG. 6.
Figure 8:
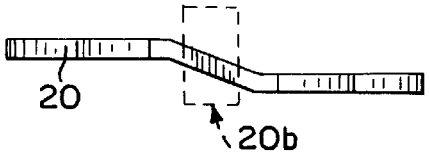
FIG. 8 is a bottom view of the support of FIG. 6.
Figure 10:
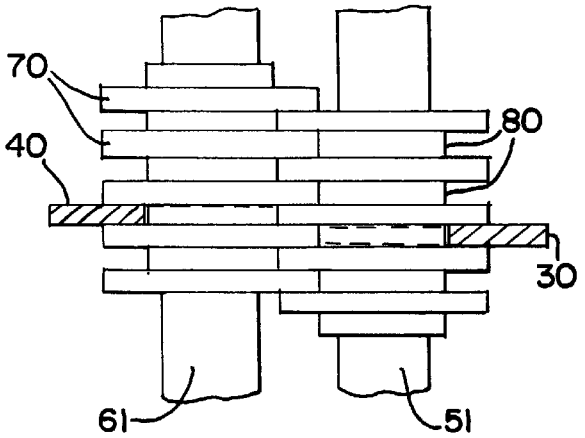
FIG. 10 is a cross-sectional view of the cutting cylinders of FIG. 9 taken along the line 10—10.
Figure 11:
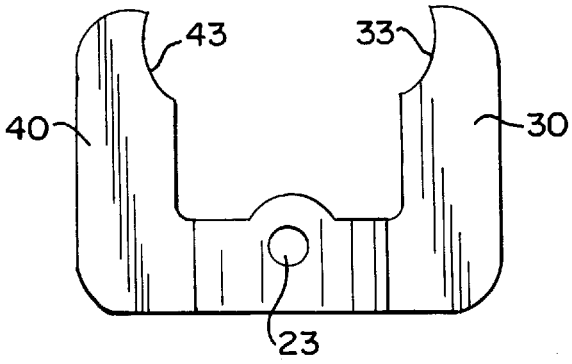
FIG. 11 is a front view of a third embodiment of the support of the present invention.
Figure 12:
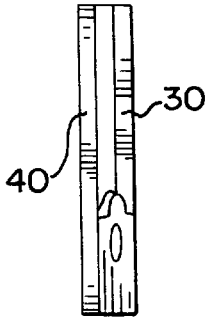
FIG. 12 is a side view of the support of FIG. 11.

There are many possible variations of the preferred embodiment. For example, a second embodiment is illustrated in FIGS. 6–10. For the second embodiment, the portion of the base 20 that is within the cutting path 7 is represented by opposing dashed brackets and the reference numeral 20*b*, as shown in FIG. 8. In this embodiment, the arm members 30, 40 include a recessed portion 32, 42 along their inside edges. These recesses 32, 42 surround a portion of the cutting cylinder. More specifically, the recesses 32, 42 surround a portion of the spacer 80, as shown in FIGS. 9 and 10. As depicted in FIGS. 7 and 9, the base 20 has a different contour than the embodiment of FIGS. 1–5. In addition, this embodiment includes two apertures 21, 22 in the base which receive shafts that secure the support 10 in place.

Figure 13:
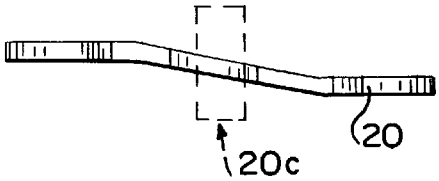
FIG. 13 is a bottom view of the support of FIG. 11.

A third embodiment is shown in FIGS. 11–15. This embodiment also includes recesses 33, 43 along the inside edge of the arm members 30, 40. However, the recesses 33, 43 of this embodiment are shaped slightly differently than those of the second embodiment. As most clearly illustrated in FIG. 13, the contour of the base 20 is also different. For the third embodiment, the portion of the base 20 that is within the cutting path 7 is represented by opposing dashed brackets and the reference numeral 20*c*, as shown in FIG. 13. Furthermore, the base 20 includes one aperture 23 which receives a shaft that secures the support 10 in place.

There are many advantages to the support of the present invention. Firstly, the support increases the capacity of small diameter cutting cylinders several fold without diminishing the quality of the cut. Secondly, the addition of the mid-shaft support does not increase the noise level of the operating paper shredder. Thirdly, the cost of introducing mid-shaft supports is minimal, especially when compared to the cost of using large diameter shafts or shafts made of stronger material.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed:

1. A support device for shafts of cutting cylinders for a shredder wherein the cylinders include a plurality of cutting disks that define a vertical cutting path, the device comprising:

a support placed across the cutting path to prevent the shafts of the cutting cylinders from separating.

2. In a paper shredder having a pair of cutting cylinders with a plurality of cutting disks that define a vertical cutting path, a support placed across the cutting path of the paper shredder, the support comprising:

a) a base and b) two arm members extending upward from the base such that each arm member is associated with a different cutting cylinder.

3. The support recited in claim 2 wherein the base is nonlinear.

4. A support placed across a vertical cutting path defined by a pair of cutting disks of cutting cylinders of a paper shredder, the support comprising:

a) a base and b) two arm members extending upward from the base such that each arm member is associated with a different cutting cylinder, each arm member having an inside edge and an outside edge, each arm member further having a recess along a portion of the inside edge.

5. The support recited in claim 4 wherein the base is nonlinear.

6. A shredder comprising:

a) a housing b) at least two cutting cylinders, each cylinder comprising:

i) a shaft;

ii) a plurality of cutting disks arranged on the shaft;

iii) a plurality of spacers alternatingly arranged on the shaft between the cutting disks; and c) at least one support placed across a vertical cutting path defined by the cutting disks of the cylinders for preventing the cylinders from separating.

7. The shredder of claim 6 wherein there are two cylinders.

8. The shredder of claim 6 wherein the spacers are integral with the cutting disks.

9. The shredder of claim 6 wherein the support is integral with the housing of the shredder.

10. The shredder of claim 6 wherein the support further comprises:

a) a base and b) two arm members extending upward from the base, each arm member having an inside edge and an outside edge, each arm member further having a recess along a portion of the inside edge, the recess adapted to substantially abut a portion of a spacer.

11. The support recited in claim 10 wherein the base is nonlinear.

* * * * *